US010502046B2

(12) United States Patent
Mahjoub et al.

(10) Patent No.: US 10,502,046 B2
(45) Date of Patent: Dec. 10, 2019

(54) SENSOR STANDOFF

(71) Applicant: SCHLUMBERGER TECHNOLOGY CORPORATION, Sugar Land, TX (US)

(72) Inventors: Ahmed Amine Mahjoub, Paris (FR); Sebastien Isambert, Maintenon (FR); Emmanuel Fayeulle, Paris (FR); Didier Fouillou, Saint Martin en Biere (FR); Michael L. Evans, Missouri City, TX (US); Christian Stoller, Princeton Junction, NJ (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 264 days.

(21) Appl. No.: 14/783,244

(22) PCT Filed: Apr. 8, 2014

(86) PCT No.: PCT/US2014/033354
§ 371 (c)(1),
(2) Date: Oct. 8, 2015

(87) PCT Pub. No.: WO2014/168960
PCT Pub. Date: Oct. 16, 2014

(65) Prior Publication Data

US 2016/0032708 A1 Feb. 4, 2016

Related U.S. Application Data

(60) Provisional application No. 61/809,801, filed on Apr. 8, 2013.

(30) Foreign Application Priority Data

Apr. 8, 2013 (EP) ..... 13305450

(51) Int. Cl.
*E21B 47/01* (2012.01)
*E21B 17/10* (2006.01)

(52) U.S. Cl.
CPC ..... *E21B 47/011* (2013.01); *E21B 17/1078* (2013.01)

(58) Field of Classification Search
CPC ..... E21B 47/011; E21B 17/1078
(Continued)

(56) References Cited

U.S. PATENT DOCUMENTS 4,108,256 A 8/1978 Moore, III
5,250,806 A 10/1993 Rhein-Knudsen et al.
(Continued)

FOREIGN PATENT DOCUMENTS

EP 0505260 A2 9/1992
EP 0654583 A2 5/1995
(Continued)

OTHER PUBLICATIONS

International Search Report and Written Opinion issued in International Patent application PCT/US2014/033354, dated Feb. 6, 2015. 11 pages.
(Continued)

*Primary Examiner* — Matthew R Buck
*Assistant Examiner* — Patrick F Lambe

(57) ABSTRACT

A downhole tool operable for conveyance within a wellbore extending into a subterranean formation, and for obtaining one or more measurements of the subterranean formation, wherein the downhole tool comprises a sensor, a pressure housing containing the sensor and mounted on an external surface of the downhole tool, and a sliding stabilizer covering the pressure housing.

19 Claims, 5 Drawing Sheets

(58) Field of Classification Search
USPC ..... 166/66
See application file for complete search history.

(56) References Cited

U.S. PATENT DOCUMENTS

| | | | | |
|---|---|---|---|---|
| 6,942,043 | B2 | 9/2005 | Kurkoski | |
| 7,392,861 | B2 | 7/2008 | Fouillou et al. | |
| 7,897,915 | B2 * | 3/2011 | Hall | G01V 5/10 250/254 |
| 2002/0057210 | A1 | 5/2002 | Frey et al. | |
| 2003/0155121 | A1 | 8/2003 | Jones et al. | |
| 2006/0070731 | A1 | 4/2006 | Fouillou et al. | |

FOREIGN PATENT DOCUMENTS

| | | | | |
|---|---|---|---|---|
| GB | 2251875 | A | 7/1992 | |
| WO | 2004001189 | A2 | 12/2003 | |
| WO | WO 2004001189 | A2 * | 12/2003 | E21B 47/011 |

OTHER PUBLICATIONS

International Preliminary Report on Patentability issued in International Patent application PCT/US2014/033354, dated Oct. 13, 2015. 7 pages.

* cited by examiner

SENSOR STANDOFF

BACKGROUND OF THE DISCLOSURE

In downhole tool design, maximizing tool function can be limited by the space available on the surface of and/or within the tool for sensors and other functional components. Space and/or function may also be limited by the fact that sensing operations may include controlling sensor standoff (the distance between the sensor and the wellbore wall) and/or the material/media between the sensors and the formation. Moreover, the sensors may be exposed on an external surface of the downhole tool, but may instead be covered by and/or housed within one or more internal and/or external features, which may further affect standoff control. Other related factors at issue during tool operations include ensuring adequate flow of drilling fluids within the downhole tool and along the exterior of the tool, as well as ensuring that steerability of the bottom hole assembly (BHA) is not compromised.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
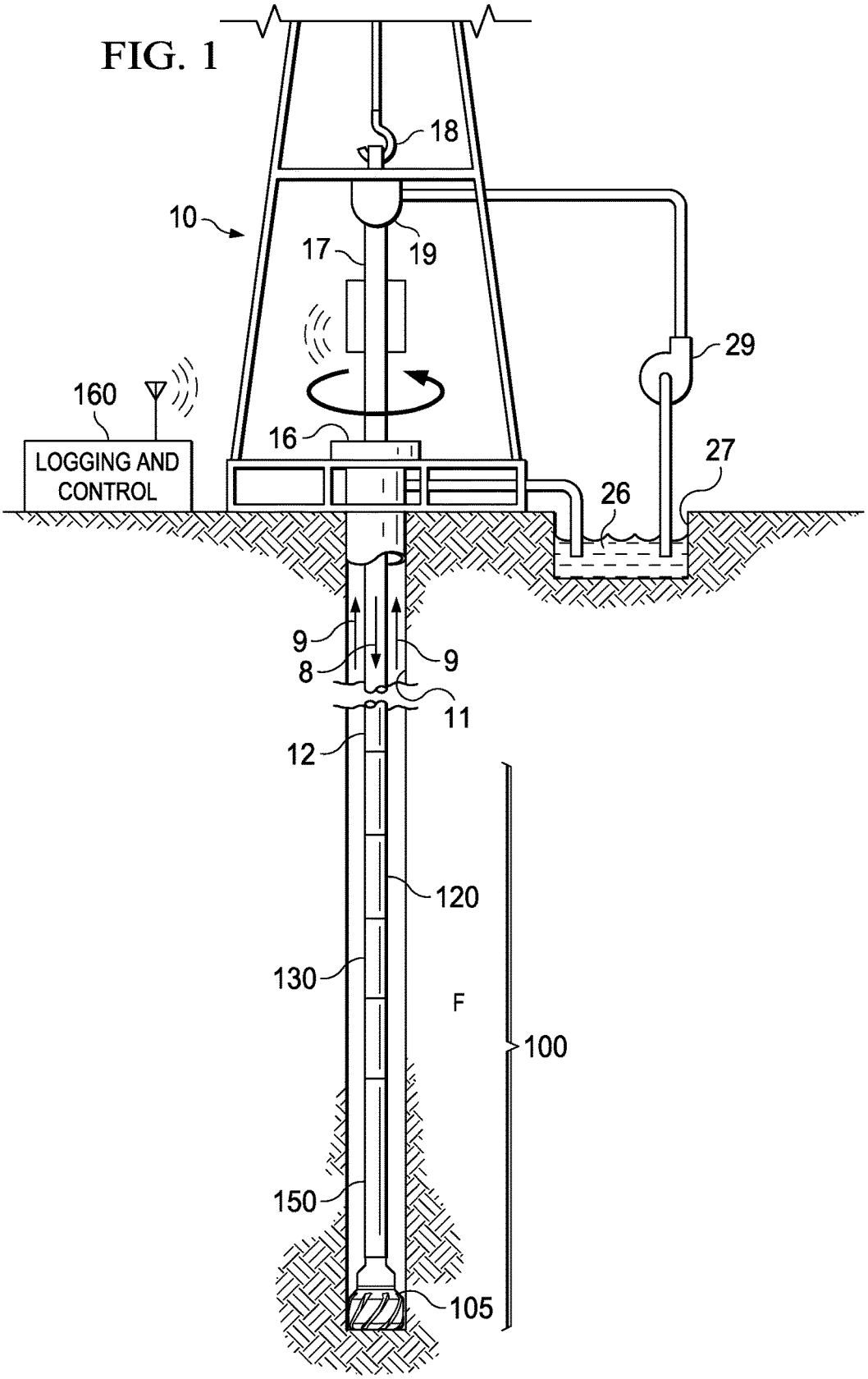
FIG. 1 is a schematic view of at least a portion of apparatus according to one or more aspects of the present disclosure.

It is to be understood that the following disclosure provides many different embodiments or examples for implementing various aspects within the present scope. Specific examples of components and arrangements are described below to simplify the present disclosure. These are, of course, merely examples and are not intended to be limiting. In addition, the present disclosure may repeat reference numerals and/or letters in the various examples. This repetition is for simplicity and/or clarity and does not in itself dictate a relationship between the various embodiments and/or configurations discussed.

The bottom-hole-assembly (BHA) and/or other portions of a drill string may include one or more logging-while-drilling (LWD) and/or measurement-while-drilling (MWD) tools to, for example, perform various downhole measurements during drilling operations. Some LWD and/or MWD tools, such as those for obtaining gamma density and neutron porosity, include sensors that are placed as close as possible to the formation. The media composition and thickness between the detectors and the formation may also be controlled.

In this context, a downhole tool may include one or more stabilizers covering one or more sensors. The detectors may be grouped into multiple sets each corresponding to one of multiple stabilizers, or the detectors may be collocated in a single grouping corresponding to a single (although perhaps longer) stabilizer. In either case, the single longer stabilizer or the two shorter stabilizers may create tortuosity for drilling fluids flowing past the downhole tool and/or otherwise generate well cleaning issues, such as during tripping out or reaming up operations in deviated beds. Such stabilizers may also increase the stiffness of the BHA, which may decrease steerability.

However, one or more aspects of the present disclosure may allow collocating multiple different sensors (e.g., sensors corresponding to gamma density, neutron porosity, neutron gamma density, and/or others) without sacrificing sensor accuracy, well cleaning performance, and/or BHA steerability. For example, the multiple sensors may correspond to a combination of a stabilizer and one or more blades each fixed to a collar of the downhole tool. The stabilizer and blade combination may cover one or more pressurized and/or otherwise sealed housings that may encapsulate the multiple sensors and perhaps associated electronics. The sensors may be connected to internal electronics of the downhole tool via, for example, one or more electrical connectors or bulkheads and jumpers and/or other cables. As such, the multiple sensors may be packaged in a limited axial space. Thus, one or more aspects of the present disclosure may be utilized to lessen the above-described effects on well cleaning and BHA steerability.

FIG. 1 is a schematic view of at least a portion of an example wellsite system that may be employed onshore and/or offshore according to one or more aspects of the present disclosure, where a wellbore 11 may have been formed in one or more subsurface formations F by rotary and/or directional drilling. As depicted in FIG. 1, a conveyance means 12 suspended within the wellbore 11 may comprise or be connected to a BHA 100, which may have a drill bit 105 at its lower end. The conveyance means 12 may comprise drill pipe, wired drill pipe (WDP), tough logging conditions (TLC) pipe, coiled tubing, and/or other means of conveying the BHA 100 within the wellbore 11.

The surface system at the wellsite may comprise a platform and derrick assembly 10 positioned over the wellbore 11. The assembly 10 may include a rotary table 16, a kelly 17, a hook 18, and/or a rotary swivel 19. The conveyance means 12 may be rotated by the rotary table 16, energized by means not shown, which may engage the kelly 17 at the upper end of the conveyance means 12. The conveyance means 12 may be suspended from the hook 18, which may be attached to a traveling block (not shown), and through the kelly 17 and the rotary swivel 19, which permits rotation of the drillstring 12 relative to the hook 18. Additionally, or alternatively, a top drive system may be used.

The surface system may also include drilling fluid 26, which is commonly referred to in the industry as mud, stored in a pit 27 formed at the well site. A pump 29 may deliver the drilling fluid 26 to the interior of the conveyance means 12 via a port (not shown) in the swivel 19, causing the drilling fluid to flow downwardly through the conveyance means 12 as indicated by the directional arrow 8. The drilling fluid 26 may exit the conveyance means 12 via ports in the drill bit 105 and/or one or more dedicated openings in the conveyance means, and then circulate upwardly through the annulus region between the outside of the conveyance means 12 and the wall of the wellbore, as indicated by the directional arrows 9. The drilling fluid 26 may be used to lubricate the drill bit 105, carry formation cuttings up to the surface as it is returned to the pit 27 for recirculation, and/or create a mudcake layer (not shown) on the walls of the wellbore 11. Although not pictured, one or more other circulation implementations are also within the scope of the present disclosure, such as a reverse circulation implementation in which the drilling fluid 26 is pumped down the annulus region (i.e., opposite to the directional arrows 9) to return to the surface within the interior of the conveyance means 12 (i.e., opposite to the directional arrow 8).

The BHA 100 may include any number and/or type(s) of downhole tools, schematically depicted in FIG. 1 as tools 120, 130, and 150. Examples of such downhole tools include an acoustic tool, a density tool, a directional drilling tool, a DFA tool, a drilling tool, an EM tool, a fishing tool, a formation evaluation tool, a gamma density tool, a natural gamma ray tool, a gravity tool, an intervention tool, an LWD tool, a magnetic resonance tool, an MWD tool, a monitoring tool, a mud logging tool, a neutron tool, a neutron porosity tool, a neutron gamma density tool, a nuclear tool, a perforating tool, a photoelectric factor tool, a porosity tool, a reservoir characterization tool, a reservoir fluid sampling tool, a reservoir pressure tool, a reservoir solid sampling tool, a resistivity tool, a seismic tool, a stimulation tool, a surveying tool, a telemetry tool, and/or a TLC tool, although other downhole tools are also within the scope of the present disclosure. One or more of the downhole tools 120, 130, and 150, and/or the logging and control system 160, may be utilized to perform at least a portion of a method according to one or more aspects of the present disclosure.

The downhole tools 120, 130, and/or 150 may be housed in a special type of drill collar, as it is known in the art, and may include capabilities for measuring, processing, and/or storing information, as well as for communicating with the other downhole tools 120, 130, and/or 150, and/or directly with surface equipment, such as the logging and control system 160. Such communication may utilize any conventional and/or future-developed two-way telemetry system, such as a mud-pulse telemetry system, a wired drill pipe telemetry system, an electromagnetic telemetry system, and/or an acoustic telemetry system, among others within the scope of the present disclosure. One or more of the downhole tools 120, 130, and/or 150 may also comprise an apparatus (not shown) for generating electrical power for use by the BHA 100. Example devices to generate electrical power include, but are not limited to, a battery system and a mud turbine generator powered by the flow of the drilling fluid.

During drilling operations, the downhole tools 120, 130, and/or 150 may be operable to perform measurements that may be utilized to characterize downhole conditions and/or formation properties. This information may be transmitted to the surface in real time, such as via an MWD one of the downhole tools 120, 130, and/or 150. Acquiring formation/wellbore data as early as possible during drilling operations may be desired for proactive geosteering operations and well control. Thus, logging sensors of one or more of the downhole tools 120, 130, and/or 150 may be located as close as possible to the drill bit 105 when possible.

Figure 2:
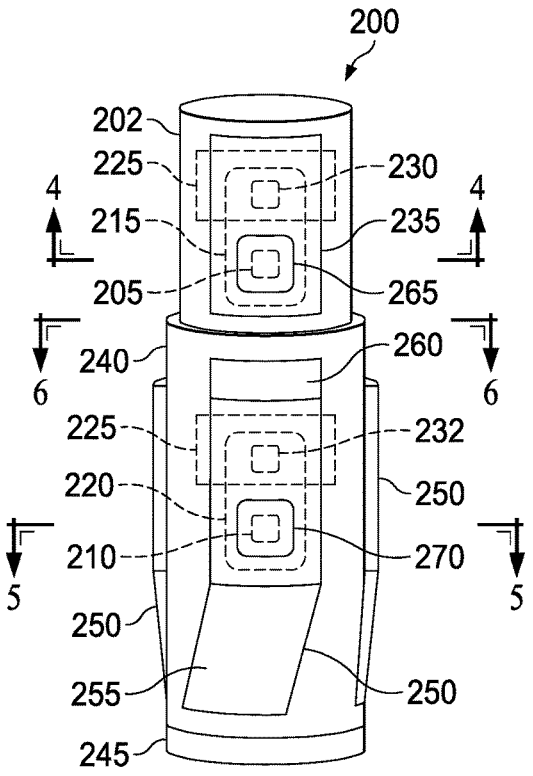
FIG. 2 is a schematic view of at least a portion of apparatus according to one or more aspects of the present disclosure.

FIG. 2 is a schematic view of a downhole tool 200 according to one or more aspects of the present disclosure. The downhole tool 200 shown in FIG. 2 may be substantially similar to or otherwise represent an example of one or more of the downhole tools 120, 130, and/or 150 shown in FIG. 1. The downhole tool 200 comprises sensors 205 and 210, which may be affected by downhole conditions, drilling parameters, the sensor package position relative to the target formation, the sensor package composition, the media composition and/or volume between the sensor package and the target formation, and/or the packaging of one or more active sources (if needed), among other factors. Examples of such sensors include, without limitation, sensors for gamma-gamma density, neutron porosity, natural gamma ray, resistivity, and/or ultrasonic measurements, among others within the scope of the present disclosure. The sensor 205 and/or the sensor 210 may each comprise one or multiple sensors, in various combination.

The sensors 205 and/or 210 may be contained and/or sealed in pressure housings 215 and 220, respectively, and may be coupled to internal electronics 225 via bulkhead and/or other types of connectors 230/232. The internal electronics 225 may be disposed in either or both of the pressure housing 215 and 220. For example, the internal electronics 225 may digitize the signals from the sensors 205 and/or 210, and their interconnections may comprise one or more serial or parallel digital buses, power supplied from the downhole tool 200 and/or surface, and perhaps additional signal connections. Power to the sensors 205 and/or 210 and/or the internal electronics 225 in either or both of the pressure housings 215 and 220 may be provided by one or more batteries and/or by power generation means operable in the downhole environment (such as power generated by mud flow and/or tool motion, for example).

The upper pressure housing 215 may be coupled to or otherwise located on an external surface 202 of the downhole tool, and may be substantially covered by a blade 235 that is coupled to the external surface 202. The lower pressure housing 220 may be coupled to and/or otherwise located on the external surface 202, and may be substantially covered by a stabilizer 240 that may be secured by a locking ring 245 and/or other means for positionally fixing the stabilizer 240 relative to the external surface 202. Thus, for example, the pressure housings 215 and 220 may be implemented in a manner permitting control of the sensor/formation standoff, such as to accommodate for the particular drilling fluid and/or other materials in the wellbore between the sensors 205 and/or 210 and the formation.

The blade 235 may project radially outward from the external surface 202 and extend axially along a portion of the length of the external surface 202 in a direction substantially parallel to the longitudinal axis of the downhole tool 200, perhaps to a length just sufficient to cover the sensor 205 (and perhaps other proximate sensors). The blade 235 may have any shape and/or size that accommodates the upper pressure housing 215 and sensor(s) 205 therein, although the shape may be selected to minimize any undesired effects of the blade 235 on the flow of drilling fluid along the external surface 202 of the downhole tool 200. The blade 235 may comprise stainless steel and/or other materials generally utilized for downhole drilling apparatus, and may be secured to the external surface 202 by any means permitting the removal of the blade 235 at surface, such as by threaded fasteners and/or other fastening means. Some implementations within the scope of the present disclosure may comprise more than one instance of the blade 235, perhaps with different sensors and/or sensor combinations.

The stabilizer 240 depicted in FIG. 2 comprises three fins 250, but may comprise any number of fins 250. The fins 250 may extend axially along the external surface 202 of the downhole tool 200 substantially parallel to the longitudinal axis of the downhole tool 200, but may also include one or more pitched portions 255 that extend helically, spirally, and/or otherwise around a circumferential portion of the external surface 202 and/or otherwise not parallel to the longitudinal axis of the downhole tool 200. In such embodiments, the fins 250 may also comprise axial portions 260, one of which may substantially or entirely cover the sensor 210 and/or the lower pressure housing 220, although the pitched portions 255 may cover the sensor 210 and/or at least a portion of the lower pressure housing 220 in other implementations.

The number of pressure housings carried by the stabilizer 240 may be equal to or less than the number of fins 250 carried by the stabilizer 240. In some implementations, one or more additional sensors may be packaged between the fins 250.

The stabilizer 240 and the blade 235 may be axially separated from each other by a distance D that may be less than about three feet (0.9 m), although other dimensions are also within the scope of the present disclosure. The extent to which the blade 235 projects radially from the external surface 202 may vary within the scope of the present disclosure, but may generally be within the effective outer diameter of the stabilizer 240. The effective outer diameter of the stabilizer 240 may be the minimum diameter that completely encircles the outermost edges of the fins 250.

The upper pressure housing 215 and/or the blade 235 may comprise a window 265 aligned with the sensor 205, and the lower pressure housing 220 and/or the stabilizer 240 may comprise one or more windows 270 aligned with the sensor 210. Each window 265 and 270 may comprise a material having a transmittance greater than the transmittance of the corresponding pressure housing, blade, and/or stabilizer portion in which the window 265/270 is located. For example, where the sensors 205 and 210 are for sensing radiation, such as gamma-gamma, neutron, and/or gamma ray sensors, the windows 265 and 270 may comprise polyether-ketone (PEK), polyether-ether-ketone (PEEK), epoxy, glass-filled epoxy, glass-filled PEEK, fiberglass, nitrile rubber, titanium, beryllium (coated or otherwise protected to avoid direct contact with corrosive borehole fluid), zirconium and/or other materials that are more transparent to such radiation relative to the steel and/or other materials forming the body or structure of the corresponding pressure housing, blade, and/or stabilizer portion. One or more of the windows 265 and 270 may comprise more than one layer of these and/or other materials. The use of hydrogenous materials as windows of epithermal and/or thermal neutron radiation may be utile for thermalizing faster (epithermal) neutrons and/or increase the probability of neutron detection in a detector of epithermal and/or thermal neutrons. One or more of the windows 265 and/or 270 may comprise a coating that may improve wear resistance without adversely affecting their function, such as one or more coatings comprising boron carbide ($B_4C$), chromium carbide ($Cr_3C_2$), tungsten carbide (WC), and/or other materials. For example, in implementations in which one or more of the windows 265 and 270 are gamma ray windows, they may be coated with boron carbide and/or chromium carbide. As another example, in implementations in which one or more of the windows 265 and 270 are neutron windows, they may be coated with chromium carbide and/or tungsten carbide. However, other coatings are also within the scope of the present disclosure.

Figure 3:
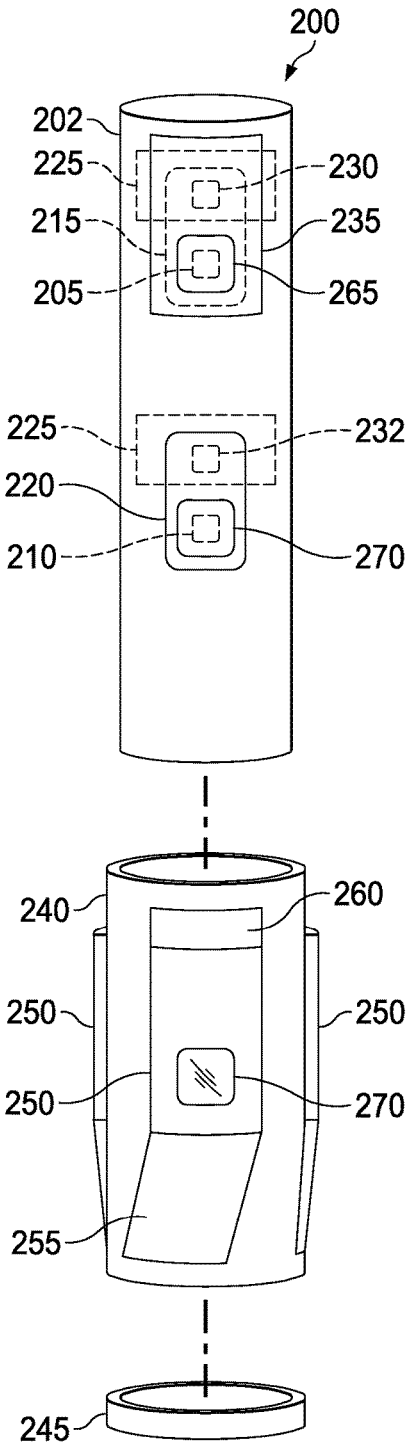
FIG. 3 is a schematic view of at least a portion of apparatus according to one or more aspects of the present disclosure.

FIG. 3 is a schematic view of the downhole tool 200 shown in FIG. 2 depicting the stabilizer 240 before being assembled onto the downhole tool 200. The stabilizer 240 may be installed by sliding the stabilizer 240 relative to the external surface 202, perhaps including orienting the stabilizer 240 such that the windows 270 are aligned with the sensor 205 (e.g., as depicted in FIG. 2). The locking ring 245 may then be installed, perhaps also by sliding it relative to the external surface 202. Various options exist for locking the position of the stabilizer 240 to prevent axial and/or rotary motion relative to the external surface 202. For example, in addition to the locking ring 245, or as an alternative to the locking ring 245, one or more pins, threaded fasteners, clamps, additional retaining rings, and/or other fastening means may be utilized.

Figure 4:
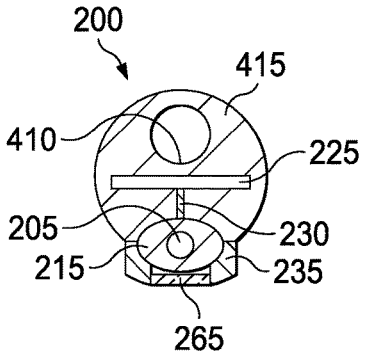
FIG. 4 is a schematic view of at least a portion of apparatus according to one or more aspects of the present disclosure.

FIG. 4 is a cross-sectional view of the downhole tool 200 depicted in FIG. 2 taken along line 4-4. The downhole tool 200 may further comprise a flowpath 410 and/or other passageway central to the collar 415 of the downhole tool. The flowpath 410 may, for example, be operable to transmit drilling fluids and/or other fluids, such as in implementations in which the downhole tool 200 is, comprises, or forms a portion of an MWD or LWD tool. FIG. 4 also depicts example relative locations of the sensor 205, the upper pressure housing 215, the electronics 225, the connector 230, the blade 235, and the window 265. However, the relative locations of such components within the scope of the present disclosure are not limited to the examples depicted in FIG. 4.

Figure 5:
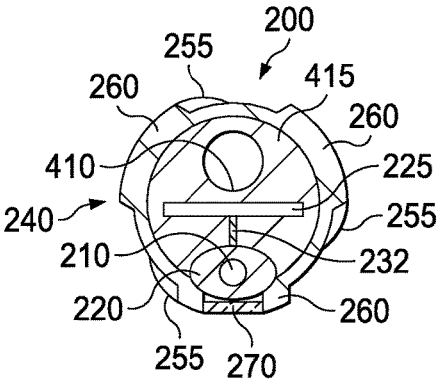
FIG. 5 is a schematic view of at least a portion of apparatus according to one or more aspects of the present disclosure.

FIG. 5 is a cross-sectional view of the downhole tool 200 depicted in FIG. 2 taken along line 5-5 and demonstrating the continuation of the flowpath 410 within the collar 415. FIG. 5 also depicts example relative locations of the sensor 210, the lower pressure housing 220, the electronics 225, and the connector 232, as well as the pitched portions 255, the axial portions 260, and the window 270 of the stabilizer 240. However, as with the example implementation depicted in FIG. 4, the relative location of such components within the scope of the present disclosure is not limited to the example depicted in FIG. 5.

Figure 6:
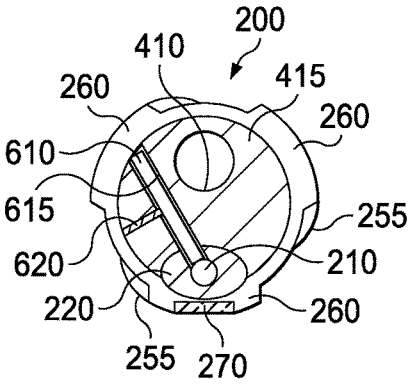
FIG. 6 is a schematic view of at least a portion of apparatus according to one or more aspects of the present disclosure.

FIG. 6 is a cross-sectional view of the downhole tool 200 depicted in FIG. 2 taken along line 6-6. The downhole tool 200 may further comprise a radioisotopic, electronic, or other radiation source 610, which may be removably positioned within a corresponding recess, passageway, and/or other feature 615 of the collar 415, as shown in FIG. 6. For example, the feature 615 may be an elongated recess having a substantially cylindrical cross-section and extending between the external surface 202 of the collar 415 and the lower pressure housing 220, perhaps extending a distance into the lower pressure housing 220 to facilitate connection with the sensor 210. The axial or longitudinal station of the feature 615 may be between the lower end of the blade 235 and the upper end of the stabilizer 240, and may be located within independent, pressure-sealed packaging that may be oriented to ensure a predetermined orientation relative to one or more of the sensors 205 and 210. The feature 615 may be oriented in a plane perpendicular to the longitudinal axis of the downhole tool 200 (as shown in FIG. 6) or otherwise. The radiation source 610 may be or comprise any of various types of radiation sources, such as a neutron source or a gamma ray source, among others within the scope of the present disclosure.

The downhole tool 200 may also comprise a locking feature 620 operable to retain the radiation source 610 within the feature 615. For example, the locking feature 620 may be threaded into the collar 415 after the radiation source 610 has been inserted into the feature 615. Of course, other means for retaining the radiation source 610 during operations are also within the scope of the present disclosure.

Figure 7:
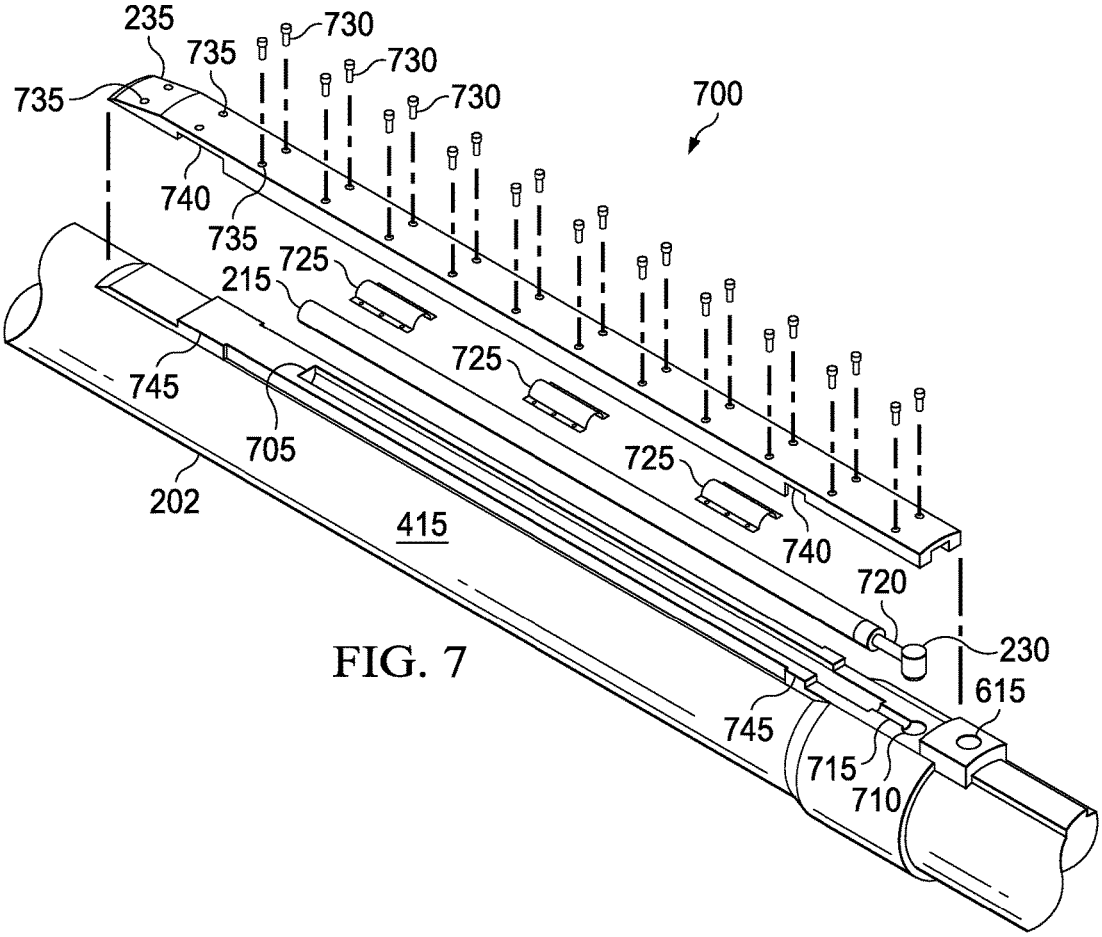
FIG. 7 is a schematic view of at least a portion of apparatus according to one or more aspects of the present disclosure.

FIG. 7 is a schematic view of a portion of an example implementation of the downhole tool 200 shown in FIGS. 2-6 and designated herein by reference numeral 700. Reference numerals in FIG. 7 that are repeated from FIGS. 2-6 indicate that the component referenced in FIG. 7 is substantially similar or identical to the corresponding component depicted in FIGS. 2-6, with the possible exceptions described below.

The downhole tool 700 comprises one or more sensors and perhaps associated electronics sealed within the upper pressure housing 215. A recess and/or other feature 705 extending into the external surface 202 of the collar 415 may be configured to receive the upper pressure housing 215, perhaps in a manner designed to aid in properly orienting the upper pressure housing 215 relative to other components of the downhole tool 200 during assembly. For example, the length, depth, perimeter shape, and/or other aspects of the upper pressure housing 215 may be substantially similar to corresponding aspects of the feature 705, such that the upper pressure housing 215 may be installed solely in the position which properly orients the electrical connector 230 relative to a corresponding receptacle 710, and/or which properly orients the one or more sensors contained within the upper pressure housing 215 relative to a radiation source and/or the formation. The radiation source (not shown) may be installed into the collar 415 via the feature 615. The receptacle 710 may be a portion of or otherwise associated with the feature 705, such as via a channel 715 extending between the receptacle 710 and the feature 705, which may be configured to receive cabling 720 extending between the upper pressure housing 215 and the connector 230. The cabling 720 may be flexible, and extend in a direction substantially parallel to the longitudinal axis of the downhole tool 700 (as shown in FIG. 7) or otherwise, perhaps including in implementations lacking the channel 715. The upper pressure housing 215 may be secured within the feature 705 by one or more clamps and/or other fastening means 725. The downhole tool 700 may comprise one or more additional metallic covers and/or other features (not shown) protecting the cabling 720 and/or the connectors 230.

The blade 235 may then be installed and thus cover the upper pressure housing 215. For example, a number of threaded fasteners 730 may extend through corresponding openings in the blade 235 and into corresponding threaded apertures 735 in the collar 415. However, additional and/or alternative means for securing the blade 235 to the collar 415 over the upper pressure housing 215 are also within the scope of the present disclosure.

The blade 235 may also comprise one or more features operable to engage corresponding components or features of the collar 415, such that the blade 235 may be installed in a sole orientation relative to the other components of the downhole tool 200. For example, one or more edges of the blade 235 may comprise indentations, recesses, and/or other features 740 configured to engage corresponding bosses, protrusions, and/or other features 745 of the collar 415. The features 745 may be integral to the collar 415, or may be features of one or more discrete members coupled to the collar 415 by threaded fasteners, welding, and/or other means.

Figure 8:
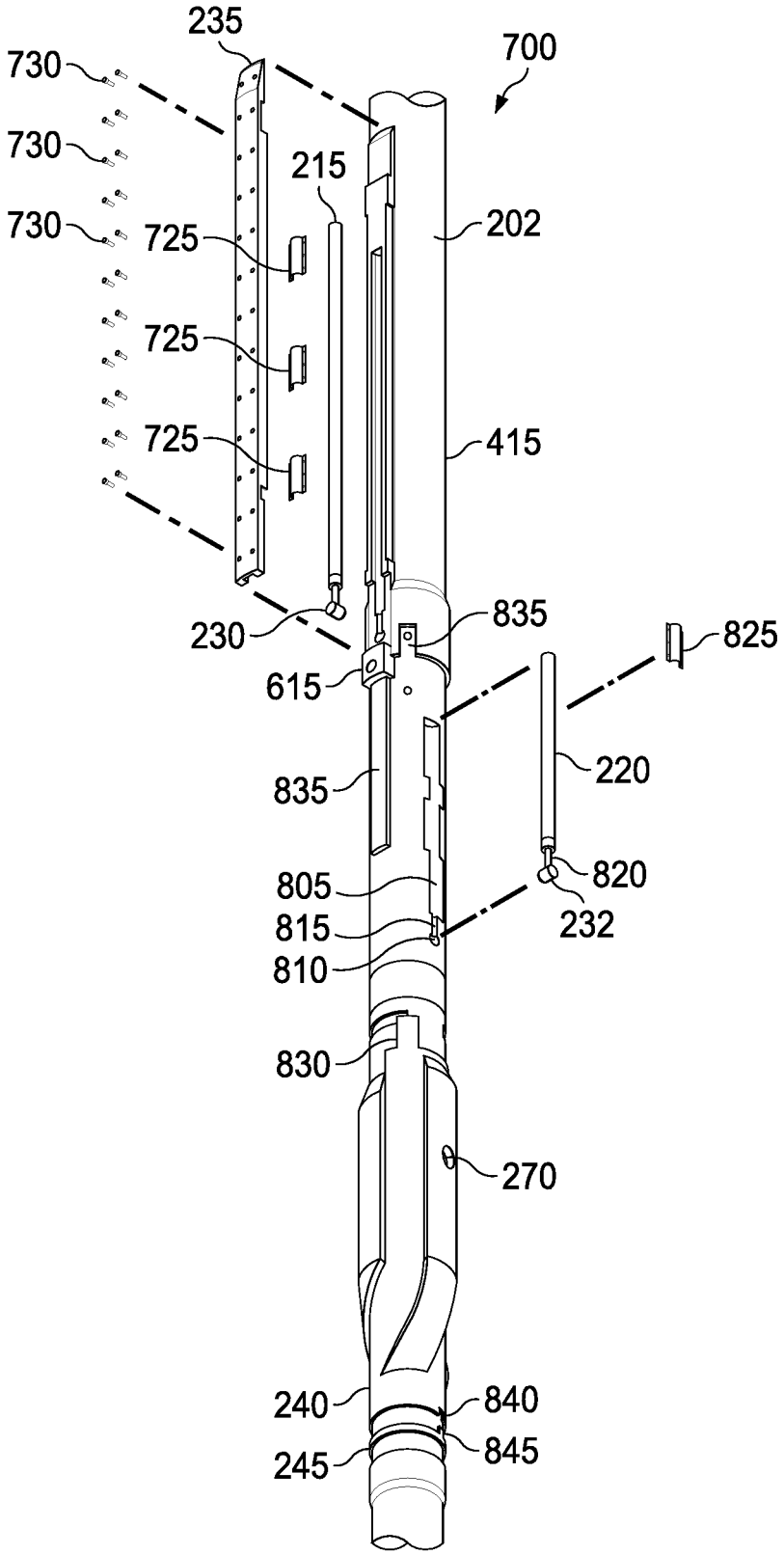
FIG. 8 is a schematic view of at least a portion of apparatus according to one or more aspects of the present disclosure.

FIG. 8 is a schematic view of a larger portion of the downhole tool 700 shown in FIG. 7. As with the above description of FIG. 7, reference numerals in FIG. 8 that are repeated from FIGS. 2-6 indicate that the component referenced in FIG. 8 is substantially similar or identical to the corresponding component depicted in FIGS. 2-6, with the possible exceptions described below.

The downhole tool 700 comprises one or more sensors sealed within the lower pressure housing 220. A recess and/or other feature 805 extending into the external surface 202 of the collar 415 may be configured to receive the lower pressure housing 220, perhaps in a manner designed to aid in properly orienting the lower pressure housing 220 relative to other components of the downhole tool 200 during assembly. For example, the length, depth, perimeter shape, and/or other aspects of the lower pressure housing 220 may be substantially similar to corresponding aspects of the feature 805, such that the lower pressure housing 220 may be installed solely in the position which properly orients the electrical connector 232 relative to a corresponding receptacle 810, and/or which properly orients the one or more sensors contained within the lower pressure housing 220 relative to a radiation source. The radiation source (not shown) may be installed into the collar 415 via the feature 615. The receptacle 810 may be a portion of or otherwise associated with the feature 805, such as via a channel 815 extending between the receptacle 810 and the feature 805, which may be configured to receive cabling 820 extending between the lower pressure housing 220 and the connector 232. The lower pressure housing 220 may be secured within the feature 805 by one or more clamps and/or other fastening means 825.

The stabilizer 240 may then be installed by sliding over the external surface 202 of the collar 415 until covering the lower pressure housing 220. The stabilizer 240 may also comprise one or more features operable to engage corresponding components or features of the collar 415, such that the stabilizer 240 may be installed in a sole orientation relative to the other components of the downhole tool 200. For example, one or more bosses, protrusions, and/or other features 830 of the stabilizer 240 may be configured to engage corresponding indentations, recesses, and/or other features 835 of the collar 415. The features 835 may be integral to the collar 415, or may be features of one or more discrete members coupled to the collar 415 by threaded fasteners, welding, and/or other means. The engagement of such orientation features 830/835 may ensure the window 270 of the stabilizer 240 is properly aligned with the one or more sensors contained within the lower pressure housing 220.

The ring 245 may then be installed by sliding over the external surface 202 of the collar 415 until contacting the stabilizer 240. The stabilizer 240 may also comprise one or more features operable to engage corresponding components or features of the ring 245, such as may further aid in proper orientation. For example, one or more indentations, recesses, and/or other features 840 of the stabilizer 240 may be configured to engage corresponding bosses, protrusions, and/or other features 845 of the ring 245. In such implementations, the ring 245 may serve to prevent relative rotation between the collar 415 and the stabilizer 240. The ring 245 may also comprise multiple rings, such as one serving to prevent rotation, and another to prevent axial motion.

Figure 9:
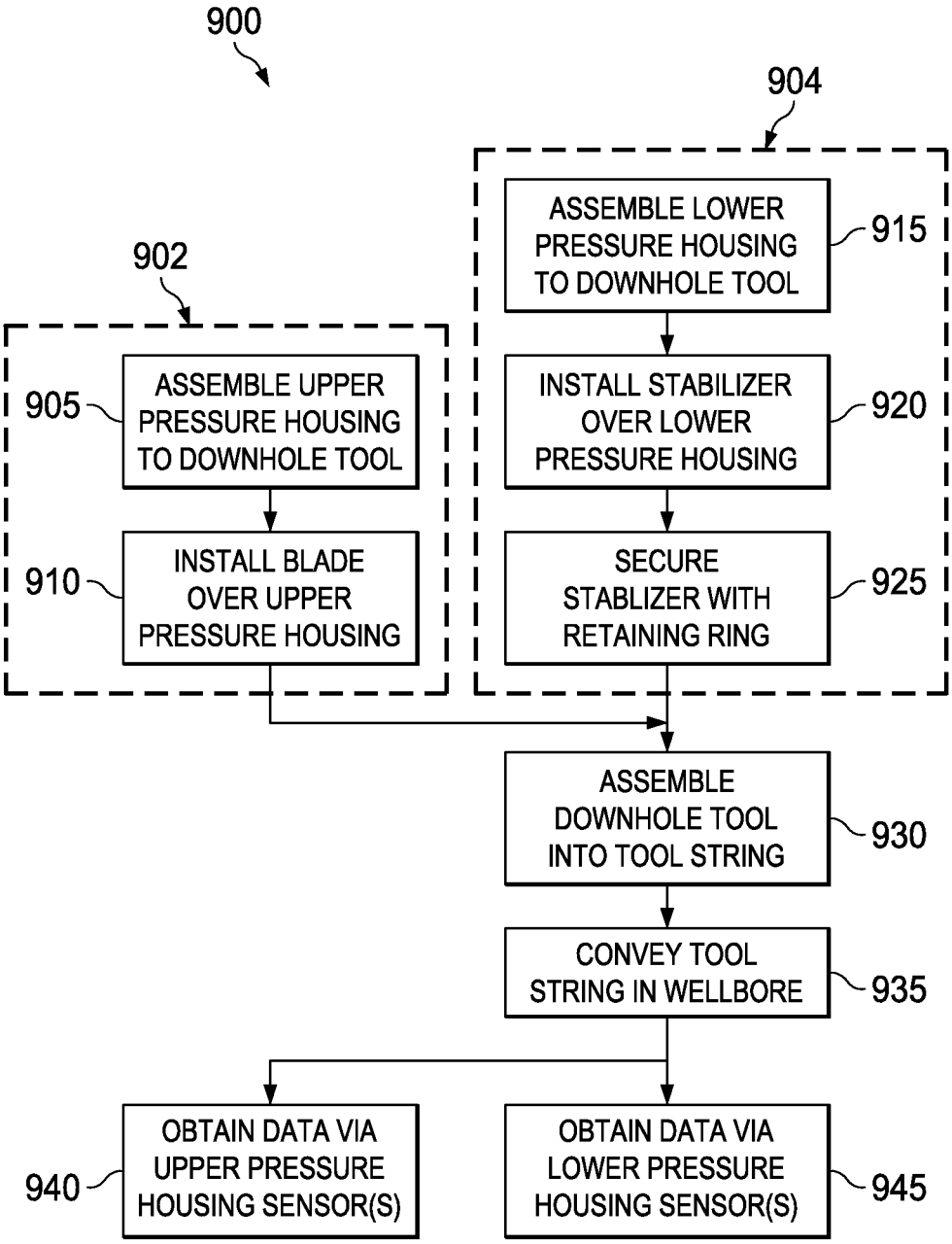
FIG. 9 is a flow-chart diagram of at least a portion of a method according to one or more aspects of the present disclosure.

FIG. 9 is a flow-chart diagram of at least a portion of a method 900 according to one or more aspects of the present disclosure. The method 900 may utilize at least a portion of the apparatus shown in at least one of FIGS. 1-8, and may comprise at least portions of methods of assembling and/or using such apparatus.

For example, the method 900 may comprise a method 902 of assembling pressurized sensors into a downhole tool and further protecting the sensors under a blade and/or other external cover. In the example of FIG. 9, the method 902 comprises assembling (905) an upper pressure housing to a downhole tool. For example, this may entail installing the upper pressure housing 215 shown in FIGS. 2-4, 7, and/or 8 into the downhole tool 200 also shown therein. Such installation may comprise inserting the upper pressure housing into a recess and/or other feature of the downhole tool, such as the feature 705 shown in FIG. 7, and perhaps securing the upper pressure housing within the feature via one or more fastening members, such as the clamps 725 shown in FIG. 7. Assembling the upper pressure housing to the downhole tool may also comprise electrically connecting one or more sensors contained within the upper pressure housing to internal electronics of the downhole tool. For example, this may entail inserting an electrical connector connected to the pressure-housed sensor(s), such as the electrical connector 230 shown in FIG. 7, into a corresponding recess and/or other feature of the downhole tool, such as the feature 710 shown in FIG. 7.

Thereafter, a blade may be installed (910) over the upper pressure housing. For example, this may entail coupling the blade 235 shown in FIGS. 2-4, 7, and/or 8 to the downhole tool by one or more threaded fasteners and/or other fastening means, such as the fasteners 730 shown in FIG. 7. Installing the blade over the upper pressure housing may further comprise aligning or otherwise orienting features of the blade relative to corresponding features of the downhole tool, such as aligning the features 740 and 745 also shown in FIG. 7.

The method 900 may also or alternatively comprise a method 904 of assembling pressurized sensors into a downhole tool and further protecting the sensors under a stabilizer and/or other external cover. In the example of FIG. 9, the method 904 comprises assembling (915) a lower pressure housing to a downhole tool. For example, this may entail installing the lower pressure housing 220 shown in FIGS. 2, 3, 5, 6, and/or 8 into the downhole tool 200 also shown therein. Such installation may comprise inserting the lower pressure housing into a recess and/or other feature of the downhole tool, such as the feature 805 shown in FIG. 8, and perhaps securing the lower pressure housing within the feature via one or more fastening members, such as the clamp 825 shown in FIG. 8. Assembling the lower pressure housing to the downhole tool may also comprise electrically connecting one or more sensors contained within the lower pressure housing to internal electronics of the downhole tool. For example, this may entail inserting an electrical connector connected to the pressure-housed sensor(s), such as the electrical connector 232 shown in FIG. 8, into a corresponding recess and/or other feature of the downhole tool, such as the feature 810 shown in FIG. 8.

Thereafter, a stabilizer may be installed (920) over the lower pressure housing. For example, this may entail sliding the stabilizer 240 shown in FIGS. 2, 3, 5, 6, and/or 8 over the lower pressure housing 220 also shown therein. This may further entail optically aligning a radiation transparent and/or other window carried by the stabilizer with one or more sensors contained within the lower pressure housing. Installing the stabilizer over the lower pressure housing may further comprise aligning or otherwise orienting features of the stabilizer relative to corresponding features of the downhole tool, such as aligning the features 830 and 835 shown in FIG. 8.

The method 904 may further comprise securing (925) the stabilizer to the downhole tool, such as via the retaining and/or rotation-locking ring 245 shown in FIGS. 2, 3, and/or 8. Installing the ring may further comprise aligning or otherwise orienting features of the ring relative to corresponding features of the downhole tool and/or the stabilizer, such as aligning the features 840 and 845 also shown in FIG. 8. Installing the ring may comprise installing more than one ring, such as one ring preventing rotation, and another ring preventing axial motion.

The method 900 may also or alternatively comprise assembling (930), into a downhole tool string, the downhole tool which may comprise the above-described, blade-protected, upper pressure housing and/or the above-described, stabilizer-protected, lower pressure housing. For example, the downhole tool may thus be, comprise, or constitute a portion of one or more of the downhole tools 120, 130, and/or 150 shown in FIG. 1, and/or otherwise form a portion of the BHA 100 also shown in FIG. 1.

The tool string (e.g., BHA) may then be conveyed (935) within a wellbore that extends into a subterranean formation to be evaluated by the pressure-housed sensor(s) of the upper and/or lower pressure housing. In the example implementation depicted in FIG. 1, this may entail conveying the BHA 100 within the wellbore 11 to one or more depths associated with the formation F. As also shown in FIG. 1, the conveyance may be via conveyance means 12 that may comprise drill pipe, WDP, TLC pipe, coiled tubing, and/or other means of conveyance.

The sensor(s) of the upper pressure housing may then be utilized (940) to obtain data pertaining to the formation of interest. For example, the sensor(s) of the upper pressure housing may comprise one or more sensors corresponding to gamma density, neutron porosity, neutron gamma density, and/or others. The sensor(s) of the lower pressure housing may also or alternatively be utilized (945) to obtain data pertaining to the formation of interest. For example, the sensor(s) of the lower pressure housing may comprise one or more sensors corresponding to gamma density, neutron porosity, neutron gamma density, and/or others. In implementations of the method 900 comprising utilizing the sensor(s) of both the upper and lower pressure housings, such sensors may be utilized substantially simultaneously or in series.

In view of the entirety of the present disclosure, including the figures, a person of ordinary skill in the art will readily recognize that the present disclosure introduces an apparatus comprising a downhole tool operable for conveyance within a wellbore extending into a subterranean formation, wherein the downhole tool comprises: a pressure housing mounted on an external surface of the downhole tool; a sensor contained within the pressure housing; and a stabilizer operable to slide between a first position covering the pressure housing and a second position not covering the pressure housing. The stabilizer may be operable to axially and/or rotationally slide between the first and second positions. The downhole tool may be or comprise a gamma ray tool.

The stabilizer may comprise a window having a transmittance that is substantially greater than that of the stabilizer. The downhole tool may further comprise internal electronics, and at least one of the pressure housing and the sensor may be electrically connected to the internal electronics via an electrical connector. The pressure housing may seal the sensor. The downhole tool may further comprise one or more chemical or electronic radioactive sources.

The stabilizer may comprise: a first portion extending helically around the external surface; and a second portion extending axially along the external surface. The stabilizer and the blade may be axially separated by a distance of less than about three feet. The blade and the downhole tool may each be smaller in diameter than an effective outer diameter of the stabilizer.

The sensor may be a gamma density sensor, a neutron porosity sensor, a neutron gamma density sensor, an ultrasonic sensor, or a resistivity sensor. The sensor may be one of a plurality of sensors of the downhole tool, and the plurality of sensors may comprise a gamma density sensor, a neutron porosity sensor, and a neutron gamma density sensor.

In the first position, the stabilizer may be configurable between a locked configuration and an unlocked configuration, wherein motion of the stabilizer relative to the pressure housing may be prevented when the stabilizer is in the locked configuration, and wherein motion of the stabilizer relative to the pressure housing may be permitted when the stabilizer is in the unlocked configuration. A member removably coupled to the external surface of the downhole tool nay prevent the motion of the stabilizer when the stabilizer is in the locked configuration. The member may be one of a threaded fastener, a locking pin, a clamp, and a locking ring. A plurality of fasteners inserted into a corresponding one of a plurality of openings machined on the external surface of the downhole tool may prevent the motion of the stabilizer when the stabilizer is in the locked configuration. The plurality of fasteners may comprise threaded fasteners, and the plurality of openings may comprise threaded openings.

The apparatus may further comprise an assembly comprising: a suspender positioned over a wellbore extending into a subterranean formation, and the downhole tool may be suspended within the wellbore from the suspender. The suspender may comprise a derrick and/or a platform.

The pressure housing may be a first pressure housing, the sensor may be a first sensor, and the downhole tool may further comprise: a second pressure housing mounted on the external surface of the downhole tool; a second sensor contained within the second pressure housing; and a blade covering the second pressure housing. The blade may comprise a window of material having a transmittance that is substantially greater than that of the blade. The downhole tool may further comprise internal electronics, and at least one of the second pressure housing and the second sensor may be electrically connected to the internal electronics via an electrical connector. The second pressure housing may seal the second sensor. The blade may be located proximate to an uphole end of the stabilizer.

The present disclosure also introduces an apparatus comprising: a downhole tool operable for conveyance within a wellbore extending into a subterranean formation, wherein the downhole tool comprises: a first pressure housing mounted on an external surface of the downhole tool; a first sensor contained within the first pressure housing; a stabilizer operable to slide between a first position covering the pressure housing and a second position not covering the pressure housing; a second pressure housing mounted on the external surface of the downhole tool; a second sensor contained within the second pressure housing, wherein the second pressure housing seals the second sensor; a blade covering the second pressure housing, wherein the blade comprises a window of material having a transmittance that is substantially greater than that of the blade; and internal electronics, wherein at least one of the second pressure housing and the second sensor is electrically connected to the internal electronics via an electrical connector. The stabilizer may be operable to axially and/or rotationally slide between the first and second positions. The stabilizer may comprise a window having a transmittance that is substantially greater than that of the stabilizer. At least one of the first pressure housing and the first sensor may be electrically connected to the internal electronics via an electrical connector.

In the first position, the stabilizer may be configurable between a locked configuration and an unlocked configuration, wherein motion of the stabilizer relative to the pressure housing may be prevented when the stabilizer is in the locked configuration, and wherein motion of the stabilizer relative to the pressure housing may be permitted when the stabilizer is in the unlocked configuration. The stabilizer may comprise a pitched portion extending helically around the external surface, and an axial portion extending axially along the external surface.

The stabilizer and the blade may be axially separated by a distance of less than about three feet. The blade and the downhole tool may each be smaller in diameter than an effective outer diameter of the stabilizer. A member removably coupled to the external surface of the downhole tool may prevent the motion of the stabilizer when the stabilizer is in the locked configuration. The member may be a threaded fastener, a locking pin, a clamp, and a locking ring. A plurality of fasteners inserted into corresponding ones of a plurality of openings machined on the external surface of the downhole tool may prevent relative motion of the stabilizer when the stabilizer is in the locked configuration. The plurality of fasteners may comprise threaded fasteners, and the plurality of openings may comprise threaded openings.

The downhole tool may further comprise one or more radioisotopic and/or electronic radiation sources. The downhole tool may be or comprise at least one of a gamma gamma density tool and/or a natural gamma ray tool. The sensors may include one or more of a gamma density sensor, a neutron porosity sensor, a neutron gamma density sensor, an ultrasonic sensor, or a resistivity sensor. The first pressure housing may seal the first sensor. The second pressure housing may seal the second sensor.

The present disclosure also introduces a method comprising: sliding a stabilizer from a first position to a second position along an external surface of a downhole tool, wherein the stabilizer covers a pressurized sensor housing mounted on the external surface of the downhole tool when the stabilizer is in the second position but not when the stabilizer is in the first position; and then inserting the downhole tool into a wellbore extending into a subterranean formation. The method may further comprise operating the downhole tool within the wellbore. The method may further comprise collecting data from a sensor in the pressurized sensor housing, wherein the data may be indicative of a characteristic of a subterranean formation adjacent to the downhole tool. The method may further comprise using a first sensor and a second sensor. Using the first sensor and using the second sensor may occur substantially simultaneously.

The foregoing outlines features of several embodiments so that those skilled in the art may better understand the aspects of the present disclosure. A person skilled in the art should appreciate that they may readily use the present disclosure as a basis for designing or modifying other processes and structures for carrying out the same uses and/or achieving the same aspects introduced herein. A person skilled in the art should also realize that such equivalent constructions do not depart from the spirit and scope of the present disclosure, and that they may make various changes, substitutions and alterations herein without departing from the spirit and scope of the present disclosure. For example, although the preceding description has been described herein with reference to particular means, materials and embodiments, it is not intended to be limited to the particulars disclosed herein; rather, it extends to functionally equivalent structures, methods, and uses, such as are within the scope of the appended claims.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool operable for conveyance within a wellbore extending into a subterranean formation, wherein the downhole tool comprises:

a pressure housing mounted on an external surface of the downhole tool;

a sensor sealed within the pressure housing; and a stabilizer operable to slide on the external surface of the downhole tool between a first position covering the sensor and a second position not covering the sensor, wherein the stabilizer comprises a window configured to be in optical alignment with the sensor when the stabilizer is in the first position, wherein the window comprises a transmittance that is substantially greater than a portion of the stabilizer in which the window is located, and wherein the window is configured not to be in optical alignment with the sensor when the stabilizer is in the second position.

2. The apparatus of claim 1 wherein the stabilizer is operable to axially slide between the first and second positions.

3. The apparatus of claim 1 wherein the downhole tool further comprises internal electronics, and wherein at least one of the pressure housing and the sensor is electrically connected to the internal electronics via an electrical connector.

4. The apparatus of claim 1 wherein the downhole tool further comprises one or more radioactive sources.

5. The apparatus of claim 1 wherein the stabilizer comprises:

a first portion extending helically around the external surface; and a second portion extending axially along the external surface.

6. The apparatus of claim 1 wherein the sensor is selected from the group consisting of: a gamma density sensor; a neutron porosity sensor; a neutron gamma density sensor; an ultrasonic sensor; and a resistivity sensor.

7. The apparatus of claim 1 wherein:

in the first position, the stabilizer is configurable between a locked configuration and an unlocked configuration;

motion of the stabilizer relative to the pressure housing is prevented when the stabilizer is in the locked configuration; and motion of the stabilizer relative to the pressure housing is permitted when the stabilizer is in the unlocked configuration.

8. The apparatus of claim 7 wherein a member removably coupled to the external surface of the downhole tool prevents motion of the stabilizer when the stabilizer is in the locked configuration.

9. The apparatus of claim 1 further comprising an assembly comprising a suspender positioned over the wellbore, wherein the downhole tool is suspended within the wellbore from the suspender, and wherein the suspender comprises at least one of a derrick and a platform.

10. The apparatus of claim 1 wherein the pressure housing is a first pressure housing, the sensor is a first sensor, and the downhole tool further comprises:

a second pressure housing mounted on the external surface of the downhole tool;

a second sensor contained within the second pressure housing; and a blade covering the second pressure housing.

11. The apparatus of claim 10 wherein the downhole tool further comprises internal electronics, and wherein at least one of the second pressure housing and the second sensor is electrically connected to the internal electronics via an electrical connector.

12. The apparatus of claim 10 wherein the blade comprises a second window in optical alignment with the second sensor and having a transmittance that is substantially greater than that of a portion of the blade in which the second window is located.

13. An apparatus, comprising:

a downhole tool operable for conveyance within a wellbore extending into a subterranean formation, wherein the downhole tool comprises:

a first pressure housing mounted on an external surface of the downhole tool;

a first sensor sealed within the first pressure housing;

a stabilizer operable to slide on the external surface of the downhole tool between a first position covering the first sensor and a second position not covering the first sensor;

a second pressure housing mounted on the external surface of the downhole tool;

a second sensor contained within the second pressure housing;

a blade covering the second pressure housing; and internal electronics connected to the at least one of the first pressure housing, the first sensor, the second pressure housing, and the second sensor;

wherein at least one of the stabilizer and the blade comprises a window of material having a transmittance that is substantially greater than that of other portions of the stabilizer and the blade, wherein the window is configured to be in optical alignment with the first sensor when the stabilizer is in the first position, and wherein the stabilizer is configured not to be in optical alignment with the first sensor when the stabilizer is in the second position.

14. The apparatus of claim 13 wherein the stabilizer comprises the window, wherein the window comprises a first window having a transmittance that is substantially greater than that of the stabilizer, and wherein the blade comprises a second window having a transmittance that is substantially greater than that of the blade.

15. The apparatus of claim 13 wherein:

the downhole tool is or comprises at least one of a gamma gamma density tool or a natural gamma ray tool;

the downhole tool further comprises one or more radioisotopic or electronic radiation sources;

the first and second sensors are each selected from the group consisting of:

a gamma density sensor;

a neutron porosity sensor;

a neutron gamma density sensor;

an ultrasonic sensor; and a resistivity sensor.

16. A method, comprising:

sliding a stabilizer from a first position to a second position along an external surface of a downhole tool, wherein the stabilizer comprises a first material, wherein the stabilizer covers a sensor mounted on the external surface of the downhole tool when the stabilizer is in the second position but not when the stabilizer is in the first position, wherein the sensor is contained within a pressure housing, wherein the stabilizer comprises a window comprising a second material having a transmittance that is substantially greater than the first material, wherein the window is configured to be in optical alignment with the sensor when the stabilizer is in the second position, and wherein the window is not in optical alignment when the stabilizer is in the first position; and then inserting the downhole tool into a wellbore extending into a subterranean formation.

17. The method of claim 16 further comprising operating the downhole tool within the wellbore.

18. The method of claim 17 wherein operating the downhole tool within the wellbore comprises collecting data from the sensor in the pressure housing, wherein the collected data is indicative of a characteristic of the subterranean formation.

19. The method of claim 18 wherein:

the sensor is a first sensor;

the pressure housing is a first pressure housing;

the downhole tool further comprises:

an external blade;

a second pressure housing covered by the external blade; and a second sensor in the second pressure housing; and collecting data comprises using the first and second sensors simultaneously.

* * * * *